US008087846B2

(12) United States Patent
Ringelberg

(10) Patent No.: US 8,087,846 B2
(45) Date of Patent: Jan. 3, 2012

(54) BOLLARD CONFIGURED TO STORE A BOLLARD COUPLING

(76) Inventor: James Ringelberg, Portland, OR (US)

( * ) Notice: Subject to any disclaimer, the term of this patent is extended or adjusted under 35 U.S.C. 154(b) by 86 days.

(21) Appl. No.: 12/381,889

(22) Filed: Mar. 16, 2009

(65) Prior Publication Data

US 2010/0232876 A1 Sep. 16, 2010

(51) Int. Cl.
*E01F 13/00* (2006.01)
*E01F 9/00* (2006.01)

(52) U.S. Cl. ..... 404/6; 404/9; 49/49

(58) Field of Classification Search ..... 4/6, 9, 10; 403/13, 14, 329; 52/301, 103; 256/1, 19, 256/65.01, 65.11, 65.12, 65.13; 404/6, 9, 404/10; 40/607.01, 612; 49/34, 49, 464, 49/463, 9; 160/135, 351
See application file for complete search history.

(56) References Cited

U.S. PATENT DOCUMENTS

| | | | | | |
|---|---|---|---|---|---|
| 353,368 | A | | 11/1886 | Miller | |
| 484,572 | A | | 10/1892 | Rudert | |
| 1,987,913 | A | | 1/1935 | Schulz | |
| 2,935,304 | A | * | 5/1960 | Hewson | 256/48 |
| 3,385,566 | A | * | 5/1968 | Dwyer | 256/19 |
| 3,688,439 | A | | 9/1972 | Doxsee | |
| 3,770,245 | A | * | 11/1973 | Murdock | 256/24 |
| 3,841,609 | A | | 10/1974 | Smith | |
| 3,990,182 | A | | 11/1976 | Linder | |
| 4,286,772 | A | * | 9/1981 | Parisien | 256/65.08 |
| 4,944,493 | A | * | 7/1990 | Handy | 256/23 |
| 5,364,076 | A | * | 11/1994 | Nicholls | 256/22 |
| 5,537,778 | A | | 7/1996 | Bardwell et al. | |
| 6,375,164 | B1 | * | 4/2002 | Siegler et al. | 256/1 |
| 6,485,225 | B1 | | 11/2002 | Baker | |
| 7,077,237 | B1 | * | 7/2006 | Haake | 182/113 |
| 7,178,790 | B2 | * | 2/2007 | de Lorenzo | 256/59 |
| 7,207,370 | B2 | | 4/2007 | Snyder et al. | |
| 7,350,480 | B1 | * | 4/2008 | Hughes | 119/512 |
| 2003/0111657 | A1 | | 6/2003 | Green | |
| 2008/0075530 | A1 | * | 3/2008 | Siu | 404/9 |

* cited by examiner

*Primary Examiner* — Thomas Will
*Assistant Examiner* — Abigail A Risic
(74) *Attorney, Agent, or Firm* — Klarquist Sparkman, LLP

(57) ABSTRACT

This application concerns traffic control devices, such as bollards, configured for storage of a bollard coupling adapted to extend between a bollard and an adjacent structure. Bollards are disclosed that comprise a body defining an interior body volume and a first aperture. A bracket fixedly attached to the body defines a second aperture. The bracket is configured to reversibly receive a bollard engaging member fixedly attached to an end portion of a bollard coupling. In a first position, at least a portion of the bollard engaging member extends through the first aperture, and in a second position, the portion of the bollard engaging member extends through the second aperture. A cap being releasably secured to the body provides access to the interior body volume and at least partially retains the bollard engaging member. Associated bollard arrangements and methods are also disclosed.

21 Claims, 10 Drawing Sheets

BOLLARD CONFIGURED TO STORE A BOLLARD COUPLING

FIELD

This application concerns bollards configured to store a bollard coupling adapted to extend from the bollard.

BACKGROUND

Traffic control bollards and couplings extending between adjacent bollards are generally known. Conventional bollards have been statically affixed to the ground and have been mounted to devices that deploy bollards onto and retract bollards into, for example, streets and sidewalks. Conventional bollards have been formed of a wide variety of materials such as concrete, metal, composite materials and plastics.

Conventional bollard couplings have been permanently affixed to one or more bollards, as by embedding the coupling in concrete at the time of forming the bollard, or by bolting, welding or otherwise bonding the coupling to the bollard. Other conventional bollard couplings comprise a chain, one end of which is fastened with a padlock to a loop extending outwardly of a bollard. Removing the padlock allows the chain to drop to the ground and traffic to pass by.

Such conventional bollards and traffic control devices do not define secure and reconfigurable boundaries with means for providing secure storage of couplings.

SUMMARY

Disclosed bollards comprise a body comprising one or more body walls. The body walls can define an interior body volume and one of the body walls can define a first body slot. Some disclosed bollards also comprise a first bracket comprising first-bracket end walls and a first-bracket side wall. The first-bracket end walls, the first-bracket side wall, and the body wall can define a first-bracket volume. The first-bracket side wall defines a first-bracket slot. The first bracket extends from the body wall adjacent the first body slot such that the first body slot is in communication with the first-bracket volume. Some disclosed bollards also comprise a cap being releasably securable to the body to at least partially enclose the interior body volume and for retaining a bollard engaging member positioned within the first-bracket interior volume.

In some embodiments, the first bracket is positioned within the interior body volume. Some bollards comprise a second bracket defining a second-bracket volume for receiving a bollard engaging member positioned within the second-bracket volume.

Disclosed bollards can be combined with a bollard coupling defining an end being fixedly attached to a bollard engaging member. Such a bollard engaging member comprises a plate configured to matingly engage the first bracket. Some bollard couplings extend inwardly of the interior body volume when the plate matingly engages the first bracket in a storage position and extend outwardly relative to the interior body volume when the plate matingly engages the first bracket in a usage position.

Some disclosed bollards comprise a body defining an interior body volume and a first opening and a bracket fixedly attached to the body and defining a second opening. The bracket can be configured to reversibly receive a bollard engaging member being fixedly attached to an end portion of a bollard coupling and positioned in a selected one of a usage position and a storage position. A corresponding cap can be releasably secured to the body in a first position for securely retaining the bollard engaging member, and positionable to a second position for providing access to the interior body volume. At least one of the first opening and the second opening can comprise a slot.

Such brackets can be positioned externally relative to the interior body volume. The bollard and the bracket can be together configured such that at least a portion of the bollard engaging member extends through the second opening when the bollard engaging member is positioned in a usage position and such that at least a portion of the bollard engaging member extends through the first opening when the bollard engaging member is positioned in a storage position.

Such brackets can be positioned within the interior body volume. The bollard and the bracket can be together configured such that at least a portion of the bollard engaging member extends through the first opening when the bollard engaging member is positioned in a usage position and such that at least a portion of the bollard engaging member extends through the second opening when the bollard engaging member is positioned in a storage position.

Some bollards can be combined with a bollard coupling having a bollard engaging member comprising a plate member being oriented substantially perpendicularly to a longitudinal axis of the bollard coupling. A linking portion can extend from the plate member at about a right angle for coupling the end portion of the bollard coupling to the plate member. The plate member can urge against the body when the bollard engaging member is positioned in a usage position. In other embodiments, the plate member can urge against the bracket when the bollard engaging member is positioned in a usage position.

Some disclosed brackets comprise a bracket wall spaced from the body to define a channel therebetween. The bracket wall can define the second opening, such that the second opening is spaced from and located opposite the first opening. The channel can be sized to slidably receive the plate member.

Bollard arrangements are also disclosed. Some arrangements comprise a bollard coupling having opposing first and second ends and a bollard engaging member fixedly attached to the first end, and a bollard having a hollow body portion and a bracket mounted thereto. The bollard engaging member can comprise a plate for bearing against a portion of the bollard, and a coupling aperture through which at least a portion of the corresponding end of the bollard coupling passes. The bracket can slidably receive the plate in a first position (e.g., the bollard coupling extending outwardly of the bollard) and in a second position (e.g., the bollard coupling extending inwardly of the bollard).

Some bollard couplings have a second bollard engaging member fixedly attached to the opposing second end of the bollard coupling. The bollard arrangement can further comprise a second bollard being configured for receiving the second bollard engaging member. The second bollard can comprise a hollow body portion and a bracket mounted thereto. The second bollard engaging member can comprise a plate for urging against a portion of the second bollard. The bracket mounted to the second bollard can be mounted within the hollow body portion of the second bollard, or mounted externally relative to the hollow body portion of the second bollard.

Some bollard arrangements comprise a second bollard coupling having opposing first and second ends and a third bollard engaging member fixedly attached to the first end of the second bollard coupling. The third bollard engaging member can comprise a plate for urging against a portion of a bollard. The second bollard can comprise a second bracket extending into the hollow body portion of the second bollard for slidably receiving the plate of the third bollard engaging member in a first position (e.g., a portion of the second bollard coupling extending outwardly of the second bollard) and in a second position (e.g., a portion of the second bollard coupling extending inwardly of the second bollard).

Some bollard arrangements comprise a bollard being positioned adjacent a structure and the bollard coupling extending between the bollard and the adjacent structure in a usage position, and inwardly of the bollard in a storage position. Some bollard couplings can engage the adjacent structure. Some adjacent structures comprise a building. Some adjacent structures comprise a second bollard.

Some bollard arrangements comprising an adjacent structure also comprise a second bollard coupling. The second bollard coupling can extend between the structure and the bollard when the second bollard coupling is positioned in a second usage position, and can extend inwardly of the bollard when the second bollard coupling is positioned in a second storage position.

Methods of demarcating a boundary are disclosed. At least one bollard can be provided that is configured to reversibly receive a bollard engaging member disposed at one end of a bollard coupling. The bollard coupling can extend inwardly of the bollard when the bollard engaging member is positioned in a storage position and can extend outwardly of the bollard when the bollard engaging member is positioned in a usage position. The bollard engaging member can be positioned in the storage position or in the usage position.

In a usage position, the bollard coupling can be extended between the bollard and an adjacent structure so as to couple the bollard and the adjacent structure. A cap can be secured to the bollard in a closed position so as to secure the bollard engaging member in the usage position.

In a storage position, the bollard coupling can be placed within the bollard. A cap can be secured to the bollard in a closed position so as to secure the bollard engaging member in the storage position.

Bollard couplings are also disclosed. Some bollard couplings comprise a coupling member having at least first and second ends. At least one hasp member can be fixedly attached to the first end. The at least one hasp member can comprise a bollard engaging member having at least a first face and a second face. The first face can be configured to urge against a retaining bracket when the hasp member is positioned in a first bollard engaging position and to urge against a bollard wall when the hasp member is positioned in a second bollard engaging position. The second face can be configured to at least partially obstruct a slot in the bollard wall when the hasp member is positioned in the first bollard engaging position. The at least one hasp member can define a coupling aperture through which at least a portion of the coupling member passes.

Such coupling members can comprise a chain, and the portion of the coupling member can comprise a link in the chain. In other embodiments, the coupling member comprises a line, and the portion comprises an end portion of the line.

Methods of assembling bollards are disclosed. Some methods comprise accessing a bollard engaging member that engages a bollard having at least one wall. The bollard engaging member can be attached to an end of a bollard coupling and be at least partially positioned in one of a storage position and a usage position within a volume defined by a bracket having opposing end walls joining one of the at least one wall and a side wall spaced therefrom. The bollard engaging member can be removed from its engagement with the bollard. The bollard engaging member can be repositioned to the other one of the storage position and the usage position. The cap can be releasably secured to the bollard to retain the repositioned bollard engaging member. The act of accessing a bollard engaging member can comprise releasing a releasably secured cap.

The foregoing and other features and advantages will become more apparent from the following detailed description, which proceeds with reference to the accompanying figures.

DETAILED DESCRIPTION

The following describes bollards and associated bollard couplings that can extend from a bollard, such as between a bollard and an adjacent structure (e.g., a building, another bollard or any other structure). The disclosed bollards are configured to securely and removably engage one or more associated bollard couplings. Some disclosed bollards are configured to securely store one or more associated bollard couplings.

Figure 1:
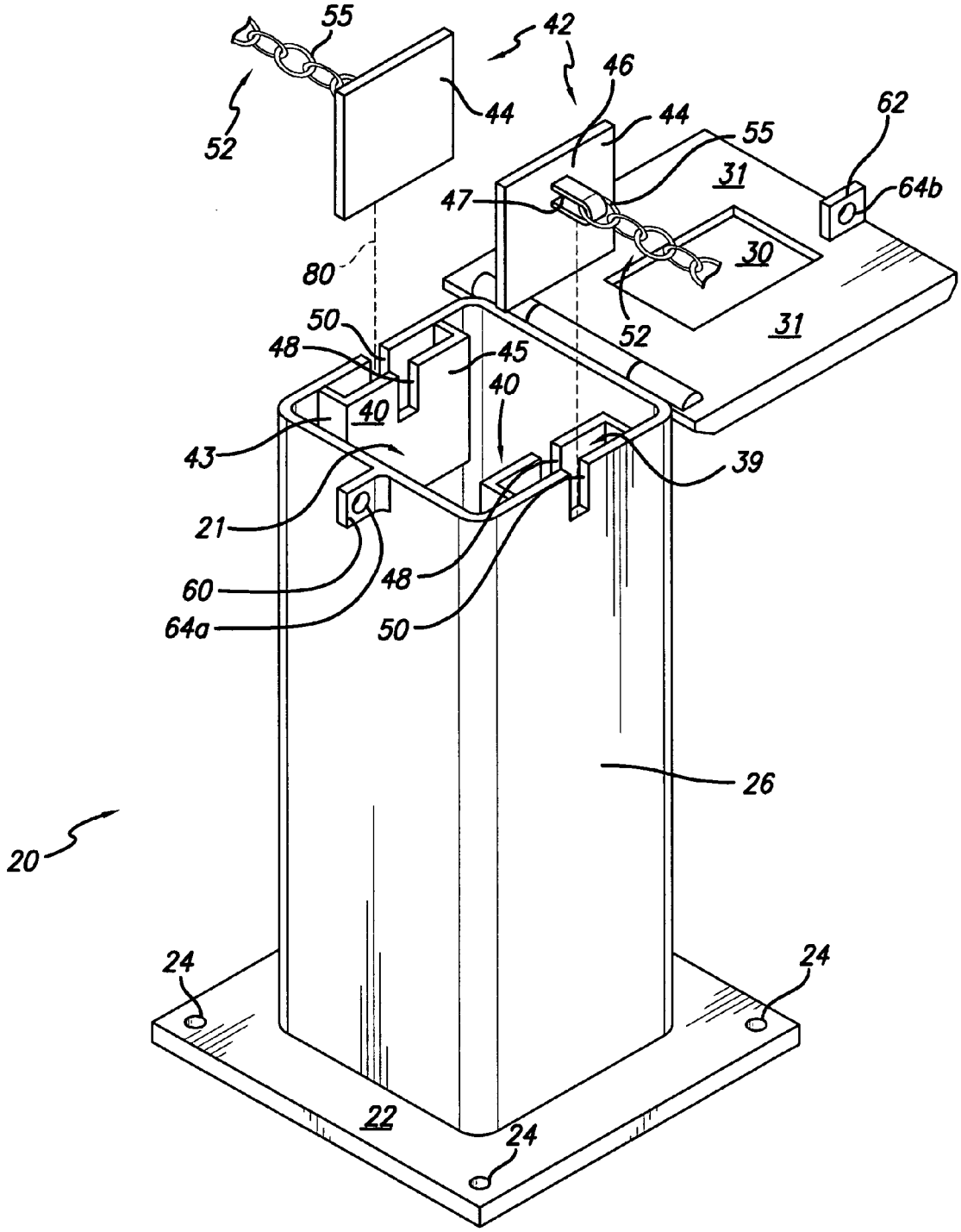
FIG. 1 shows an exploded isometric view of portions of two bollard couplings, each having a bollard engaging member fixedly attached to the portion shown, and a bollard configured to reversibly receive each of the bollard engaging members.

An exemplary bollard configuration is illustrated in FIG. 1. The illustrated bollard 20 having an internal volume 21 comprises a base 22, a hollow body 26 defining the internal volume 21, and a cap 30. The illustrated bollard 20 comprises two brackets 40 extending from portions of one or more wall members of the body 26, and positioned within the volume 21. Also shown are respective end portions of two bollard couplings 52, each having a respective bollard engaging member 42 attached thereto. As indicated by the assembly axis 80, each of the engaging members 42 can be reversibly positioned within a respective bracket 40. For example, the bollard engaging member 42 can be positioned in a usage position, as shown in FIGS. 2B and 4. Alternatively, one or both of the engaging members 42 can be positioned in a storage position in which one or more of the bollard couplings 52 extend inwardly into the interior body volume 21, as shown in, for example, FIGS. 2A, 3A, 3B, 3C and 3D.

Figure 2A:
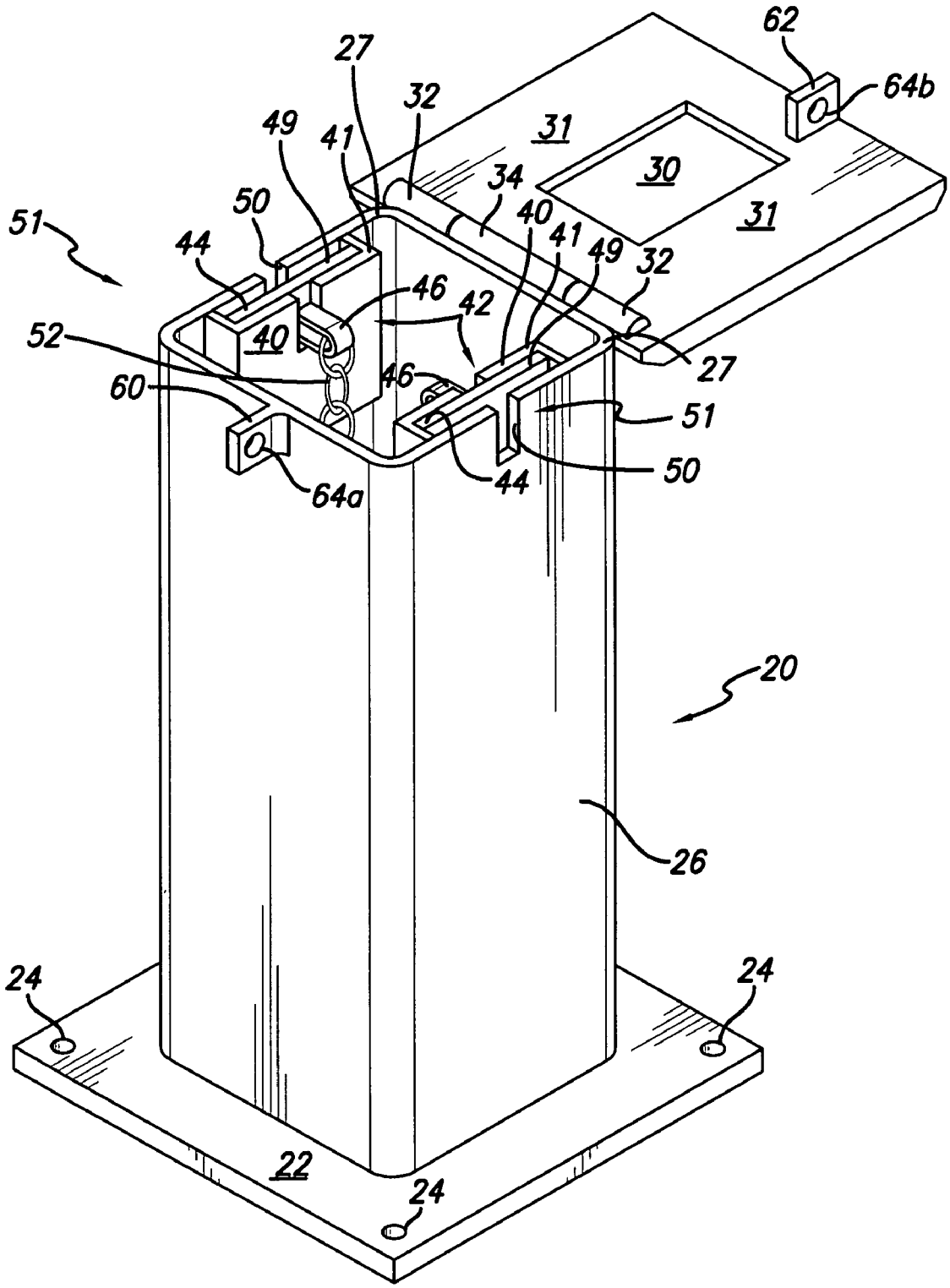
FIG. 2A shows an isometric view of the bollard shown in FIG. 1 having the bollard engaging members positioned in a storage position. Note that the respective bollard couplings shown in FIG. 1 are not shown in FIG. 2A for purposes of clarity.
Figure 2B:
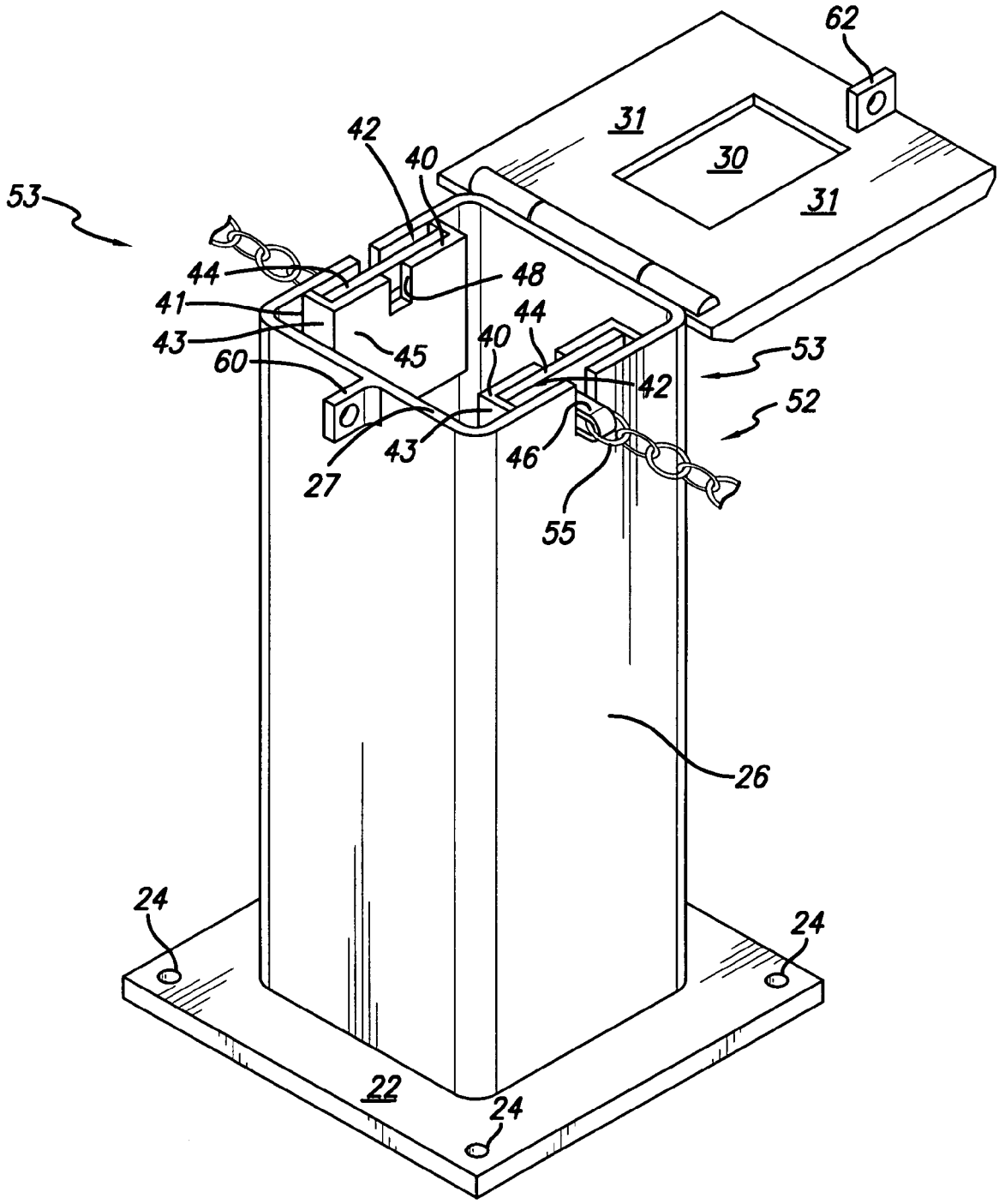
FIG. 2B shows an isometric view of the bollard shown in FIGS. 1 and 2A having the bollard engaging members shown in FIG. 2A positioned in a usage position.

As used herein, "storage position" refers to the orientation of a bollard engaging member in which the corresponding bollard coupling extends inwardly of a bollard, as shown, for example, in FIG. 2A.

As used herein, "usage position" refers to the orientation of a bollard engaging member in which the corresponding bollard coupling extends outwardly of a bollard, as shown in, for example, FIG. 2B.

With reference to FIG. 1, the hollow body 26 defines an opening, e.g., a slot 50, corresponding to each bracket 40. The slot 50 is sized to permit a bollard coupling 52 and/or a corresponding attachment portion 46 of a bollard engaging member 40 to extend through the body 26 when the bollard engaging member is positioned in a usage position 53, as shown in FIG. 2B.

With further reference to FIG. 1, the illustrated brackets 40 are fixedly attached to the body 26. End walls 43 and a side wall 45 inwardly spaced from the body 26 from a bracket 40. The end walls 43 can be joined, for example by welding, to the body 26, spacing the side wall 45 from the body 26. The end walls 43, the side wall 45 and the corresponding wall of the body 26 define a channel, e.g., an open interior bracket volume 39. This bracket volume 39 defined by each bracket 40 can slidably receive a corresponding bollard engaging member 42 in either a storage position 51 (e.g., shown in FIG. 2A) or a usage position 53 (e.g., shown in FIG. 2B), as further described below.

Continuing with reference to FIG. 1, the side wall 45 extends between the end walls 43 and defines a second opening, e.g., a slot 48, sized similarly to and positioned opposite the slot 50 to permit a bollard coupling 52 and/or a corresponding attachment portion 46 of a bollard engaging member 40 to extend through the side wall when the bollard engaging member is positioned in a storage position 51, as shown in FIG. 2A. In this embodiment, the slots 48, 50 straddle a mid-point of the bracket 40, although the slots 48, 50 can be positioned off-center relative to a mid-point of the bracket 40 (e.g., in the same direction or in opposite directions) by about equal distances.

Each illustrated bollard engaging member 42 comprises a plate 44 that extends substantially perpendicularly to the corresponding coupling 52. As shown, for example in FIG. 1, a attachment portion 46, such as a loop or hook, can extend from the plate 44 to define a coupling aperture 47 through which an end portion (e.g., a chain link 55) of the coupling 52 can pass for securing the coupling to the engaging member 42. In another embodiment, the coupling can directly engage or be secured to the plate 44.

The coupling 52 can comprise a chain, as shown, for example, in FIG. 1, a wire, rope, cable or other line.

In some embodiments, for example, embodiments in which the coupling directly engages the plate 44, the plate 44 can define a plate aperture (not shown) through which an end portion of the coupling 52 extends. To impede removal of the end portion from the plate aperture, the end portion can be knotted, melted, peened or otherwise enlarged relative to the plate aperture (as by, for example, axially engaging an enlarging member having a shoulder sized larger than the plate aperture, or engaging a dowel or pin oriented transversely to the line to anchor the line to the plate).

With reference to the embodiment illustrated in FIGS. 2A and 2B, the illustrated attachment portion 46 extends through the slot 48 when the bollard engaging member 42 is positioned in a storage position 51, as shown in FIG. 2A, and through the slot 50 when the bollard engaging member 42 is positioned in a usage position 53, as shown in FIG. 2B. The plate 44 matingly engages the bracket 40 when the bollard engaging member 42 is positioned in each of the usage and the storage positions.

In addition, the exemplary brackets 40 and slots 48, 50 are sized and positioned relative to each other (and to the bollard engaging members 42) such that the cap 30 can retain the bollard engaging members within the brackets in either a storage position 51 or a usage position 53, as shown in, for example, FIG. 4. With reference to FIG. 2A, for example, in some embodiments the top edge 41 defined by the bracket 40 is substantially aligned with the top edge 27 defined by the body 26. When positioned in either a storage position 51 or a usage position 53, a top edge 49 of the bollard engaging member 42 can be positioned in substantial alignment with, or below, the top edges 27, 41. The cap 30 can be releasably secured to the body 26 as more fully described below, and the cap flanges 31 can fit against one or more portions of (or all of) one or more of the top edges 27, 41, 49 to impede removal of a bollard engaging member 42 positioned in a bracket 40. The top edge 49 of the bollard engaging member 42 can extend above either or both of the top edges 27, 41. In such an embodiment, the cap flanges 31 can define one or more corresponding recessed regions or openings (not shown) to receive such protruding top edges of the bollard engaging member.

Figure 3A:
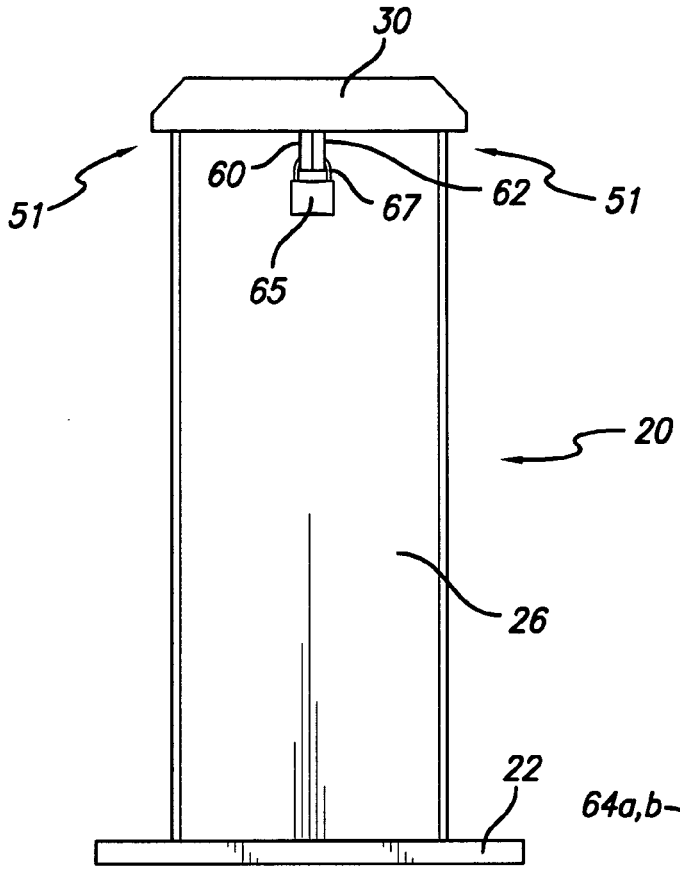
FIG. 3A shows a front elevation view of the bollard shown in FIG. 1 having the bollard engaging members in a storage position and the cap positioned in a secured position.
Figure 3B:
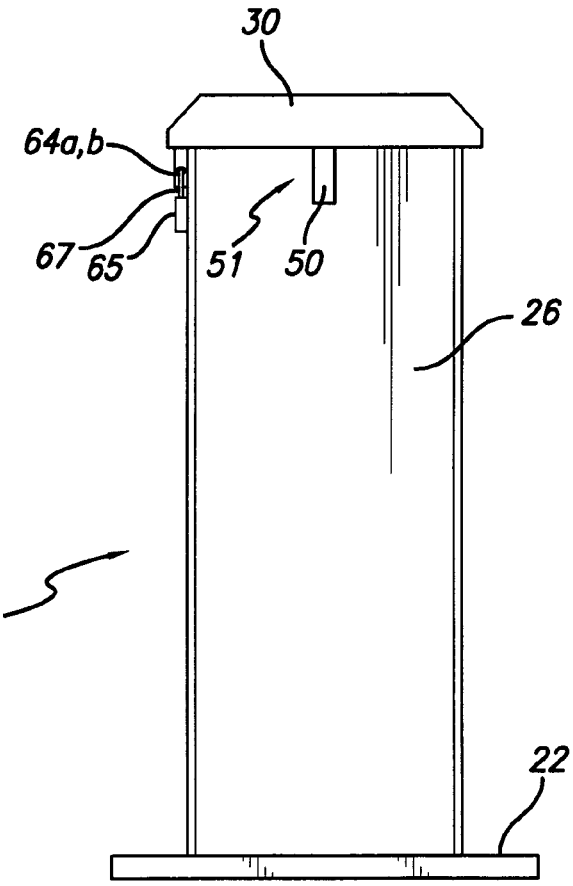
FIG. 3B shows a side elevation view of the bollard shown in FIG. 1 and configured as shown in FIG. 3A.
Figure 3C:
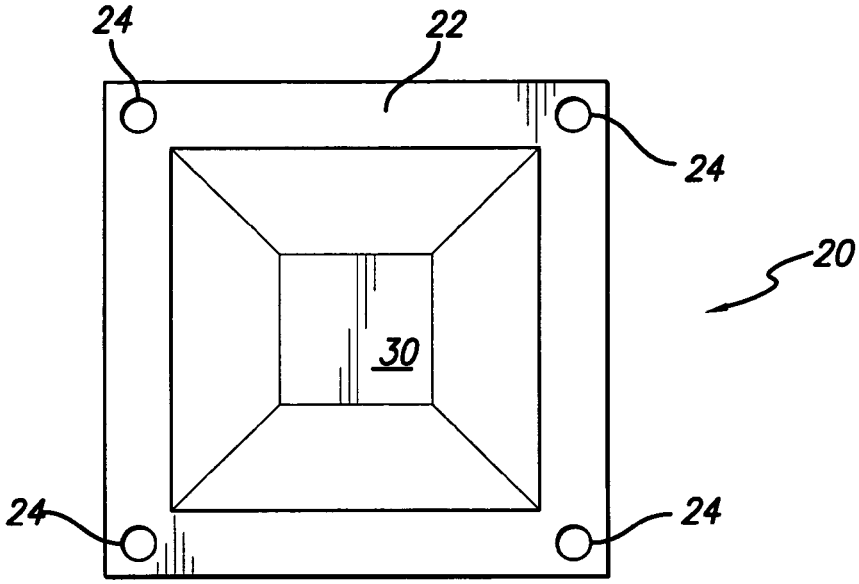
FIG. 3C shows a top plan view of the bollard shown in FIG. 1 and configured as shown in FIG. 3A.
Figure 3D:
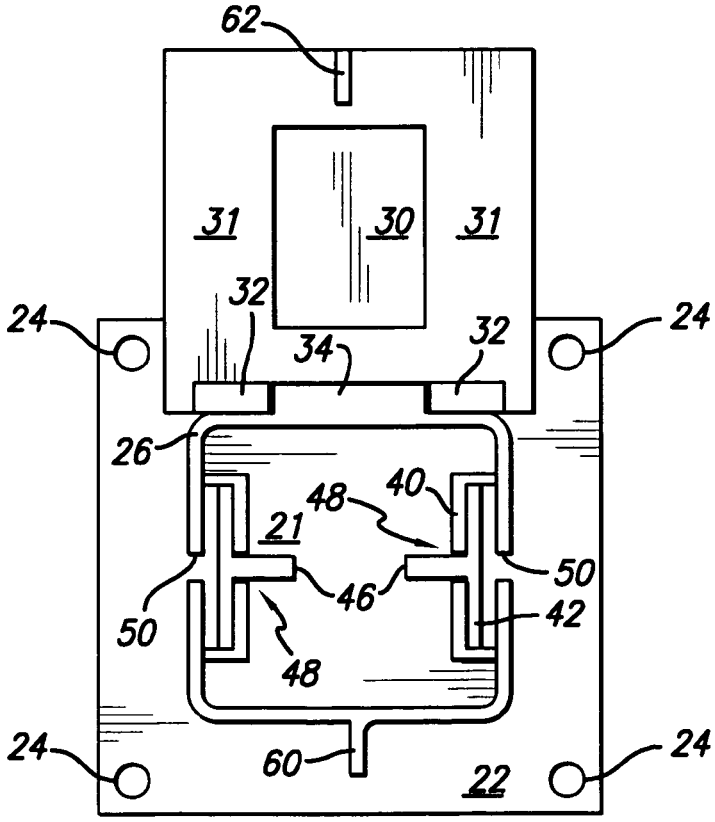
FIG. 3D shows a top plan view of the bollard shown in FIG. 1 having the bollard engaging members in a storage position and the cap in an opened position to reveal the interior of the bollard.
Figure 4:
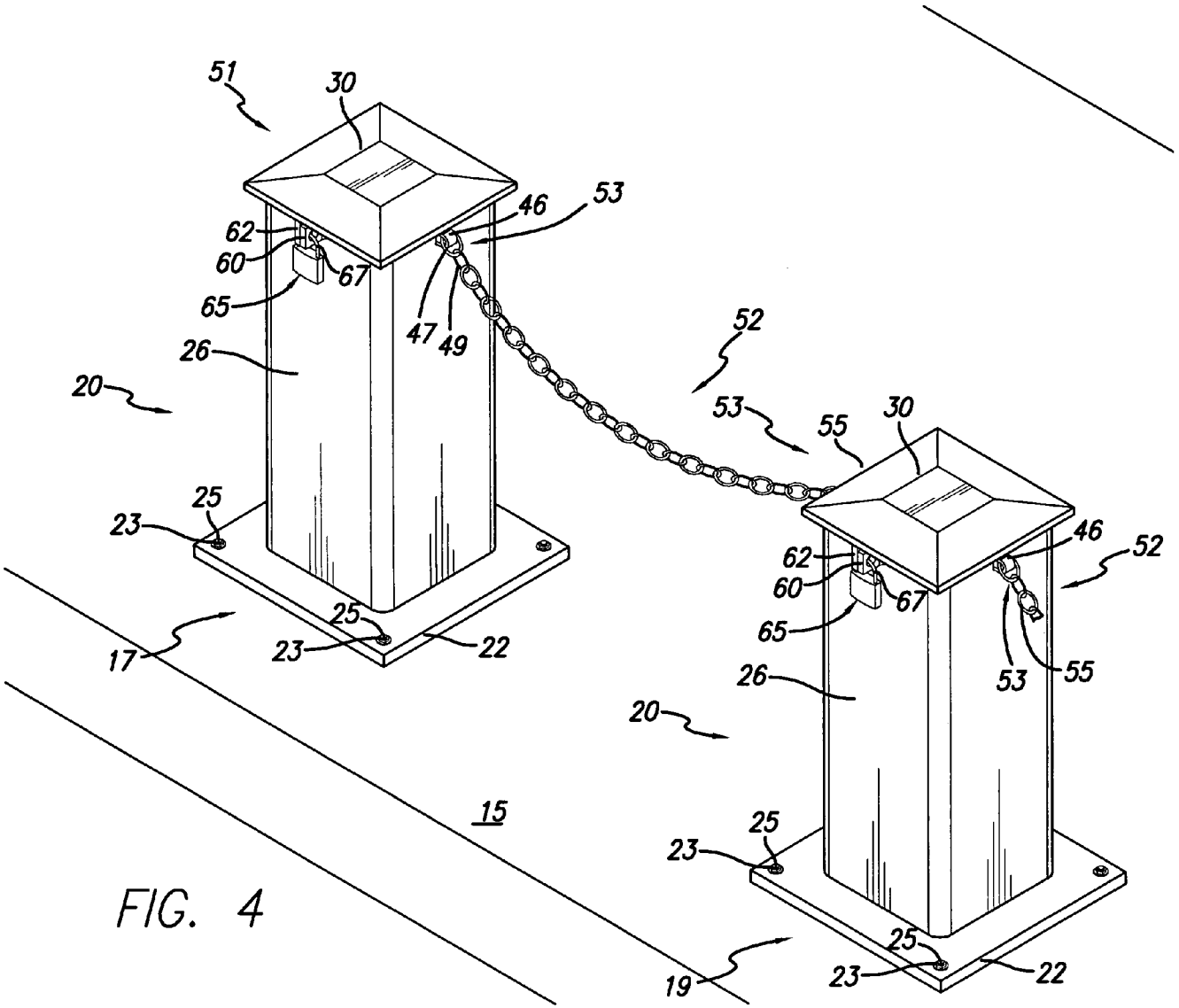
FIG. 4 illustrates an isometric view of an exemplary arrangement of bollards of the type shown in FIG. 1.

As shown in FIGS. 1, 3A and 3B, the cap 30 can be affixed to the body 26 with a hinged connection 32, 34 allowing the cap to swing from a closed position (FIGS. 3A and 3B) for retaining the bollard engaging members 42 to an open position (FIG. 1, for example) to permit access to the interior body volume 21, the brackets 40, one or more bollard couplings 52 and one or more associated bollard engaging members 42. For example, one or more first hinge portions 32 can be affixed to, or integral with, the cap 30. One or more second hinge portions 34 can be affixed to, or integral with, the body 26. A pin (not shown) can extend among such first and second hinge portions 32, 34 to form a pivotable connection between the cap 30 and the body 26. As shown in FIGS. 2A and 3B, a hinge can be located such that the hinge is substantially inaccessible from outside the bollard 20 when the cap 30 is positioned in a closed position (FIG. 3B). Although the illustrated cap 30 is hingedly affixed to the body 26, some caps are configured to be entirely removable from the body 26 to provide access to the hollow interior 21 and also configured to be fixedly secured to the body to limit unauthorized access to the hollow interior. The hinged and entirely removable embodiments just described can be releasably secured to an associated body 26. Such releasably secured caps limit access to the interior 21 and limit the ability of unauthorized individuals to reconfigure a corresponding bollard arrangement.

To allow the cap 30 to be secured to the body 26, and as shown in FIG. 1, a tab 60 can extend from the body 26 and define a first tab aperture 64*a*. Further, a corresponding tab 62 and an associated second tab aperture 64*b* can extend from the cap 30. When the cap is swung to a closed position as shown in FIG. 3A, the tab 60 and first tab aperture 64*a* are brought into alignment with the corresponding tab 62 and the second tab aperture 64*b*. In these embodiments, the cap 30 can be secured to the body 26 by passing a hasp 67 of a padlock 65 through the aligned tab apertures 64*a* and 64*b* and closing the padlock.

Alternatively, a locking mechanism (not shown) can be located on the body 26 such that a hasp of the locking mechanism engages the cap 30. For example, the locking mechanism can be a keyed locking mechanism that receives a key for rotating a hook or other hasp device. One of the cap flanges 31 can define a corresponding hasp opening, such as a slot, for receiving the hook or other hasp device, such that when positioned in a locked position, the hook or other hasp device retains the cap flange to inhibit removal or opening of the cap 30. In some instances, the only externally accessible feature of the locking mechanism is the portion of the mechanism for receiving a key.

Figure 9:
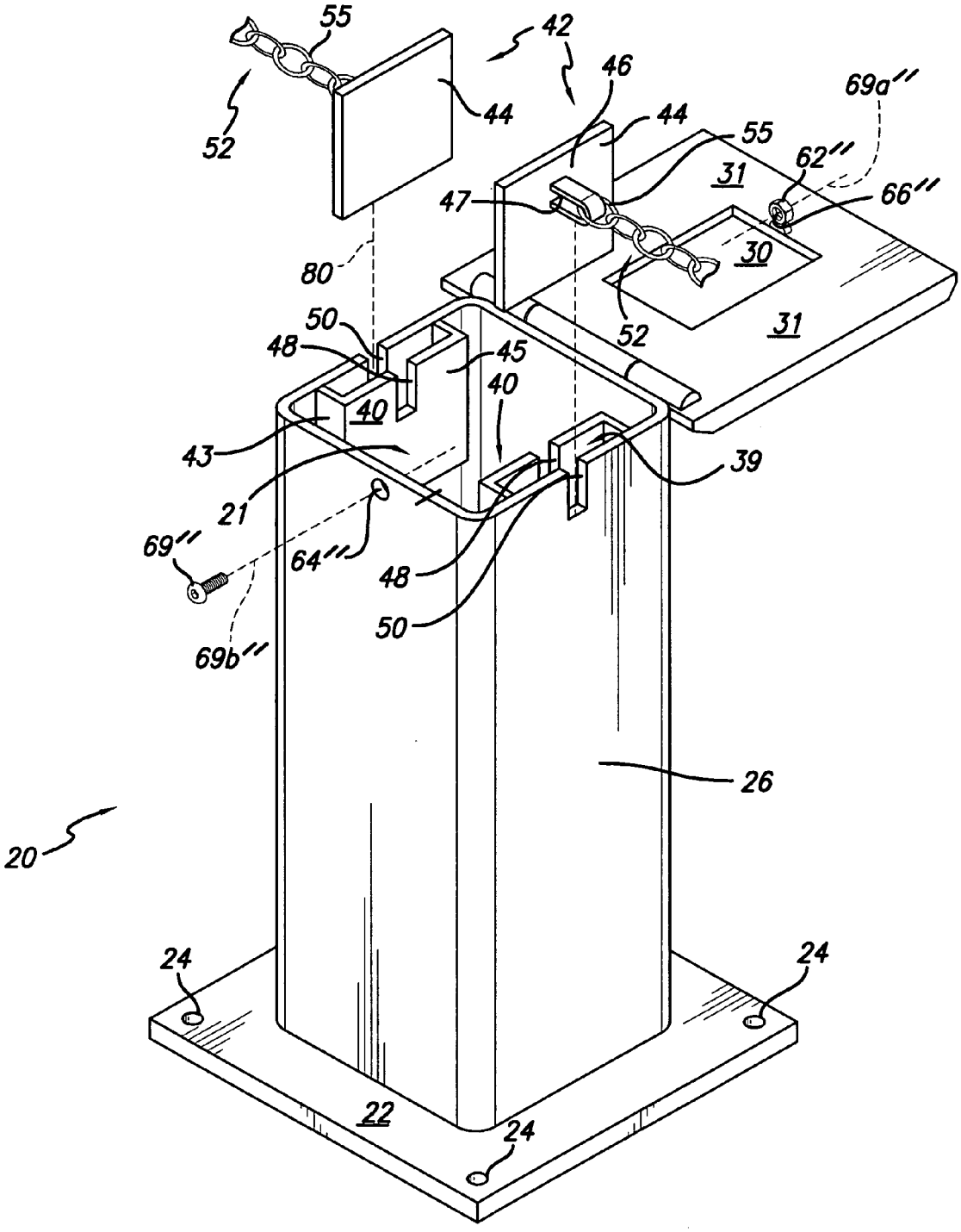
FIG. 9 illustrates a bollard having an alternative embodiment of a releasably securable cap.

Alternatively, the locking mechanism can be located in the cap 30 such that a hasp engages an inwardly extending feature (e.g., a post) of the body 26. In another example, as illustrated in FIG. 9, a cap can comprise an internally threaded member 62" defining an internally threaded bore 66" defining a longitudinal axis 69*a*". When the cap is positioned in a closed position, the internally threaded bore 66" and its corresponding longitudinal axis 69*a*" can be brought into alignment with a longitudinal axis 69*b*" defined by a through hole 64" formed in the body. A fastener 69", such as an externally threaded screw, can align with the respective axes 69*a*" and 69*b*" and extend through the through hole 64" and engage corresponding the member 62". For example, external threads of the fastener 68" can threadingly engage corresponding threads of the internally threaded bore 66". The fastener 68" can comprise any of a variety of heads for receiving various types of tools configured to apply a torque about a longitudinal axis of the fastener. For example, the head can be configured to receive a Philips head driver, a flat head driver, a hex-head driver (e.g., an Allen wrench), a fluted head driver or any of myriad other keyed drivers that are less commonly available.

With reference to FIG. 2A, a bollard coupling 52 can be stored in the bollard 20 when not in use. A bollard engaging member 42 can be positioned in a bracket 40 in a storage position 51. The bollard coupling 52 extends inwardly of the body 26 in this position, as shown in FIG. 2A, and the whole of the bollard coupling can be placed within the interior body volume 21 of the body. The cap 30 can be secured to the body 26 in a closed position, as described above and shown in FIG. 3B, to impede unauthorized removal (as by, for example theft, vandalism or mischief) of the bollard engaging member 42, and thus the bollard coupling 52. When positioned in either a storage position 51 or a usage position 53, the bollard engaging member 42 can obstruct an outwardly facing slot 50, impeding deposits of trash or other debris to either or both of the interior bracket volume 39 and the interior body volume 21.

A stored bollard coupling 52 can be repositioned from a storage position 51 to a usage position 53 by, for example, opening the cap 30, removing the bollard coupling from the interior body volume 21 and reversing the position of the bollard engaging member 42 from the storage position 51 to the usage position 53. Alternatively, a bollard coupling 52 can be repositioned from a usage position 53 to a storage position 51 by, for example, opening the cap 30 and reversing the position of the bollard engaging member 42 from the usage position 53 to the storage position 51. The cap 30 can be positioned (and/or secured) in a closed position to impede removal of the repositioned bollard engaging member 42.

Figure 5:
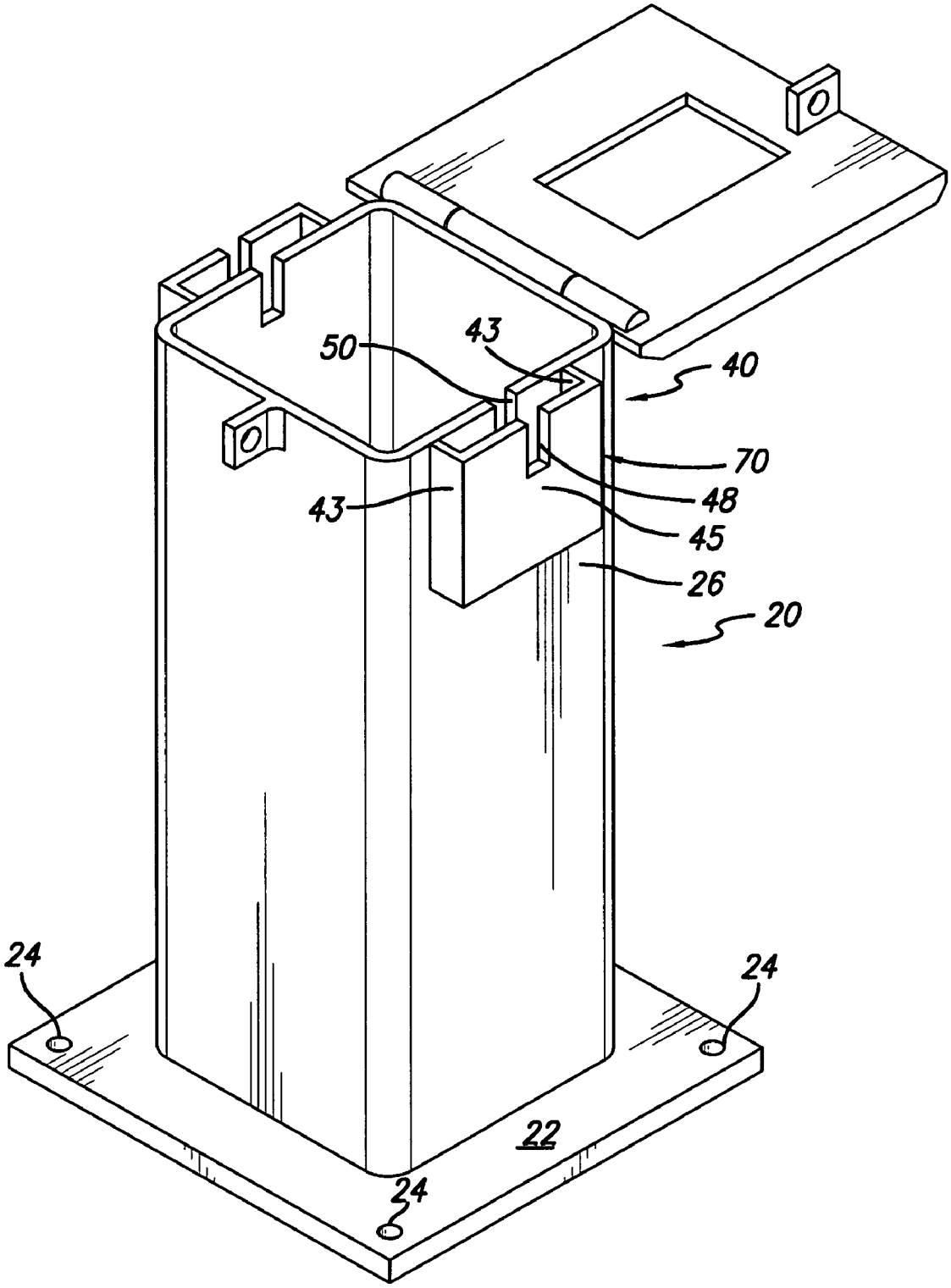
FIG. 5 illustrates an isometric view of an alternative bollard embodiment.

In FIG. 5, an alternative bollard configuration 70 having brackets 40 mounted to an exterior of the body 26 is shown. In this configuration, the bollard engaging member 42 rests within the bracket 40 and externally to the body 26. In a storage position, a bollard coupling 52 and/or a corresponding attachment portion 46 of a bollard engaging member 40 extends inwardly of the body 26 through the body slot 50, in contrast to the embodiments discussed above where the coupling 52 and/or portion 46 extends inwardly of the body through the slot 48 in the bracket. In a usage configuration of the alternative configuration 70, a bollard coupling 52 and/or a corresponding portion 46 of a bollard engaging member 40 extends outwardly of the body through the bracket slot 48. In this alternative configuration 70, like the configurations discussed above, the flanges 31 of the cap 30 can impede removal of the bollard engaging member by, for example, overlapping the top edges of the body, the bracket and or bollard engaging member.

Bollards as described herein can be secured to the ground, a foundation or other structure using well known methods. For example, the disclosed bollards can be affixed to a static structure, or can be affixed to a movable structure, such as a device for deploying a bollard to, and withdrawing a bollard from, a boundary, such as across a street, sidewalk or other unobstructed (but for the bollard and associated couplings) pathway.

In addition, bollards as described herein can be formed from plastic (e.g., polymeric) materials, metals (e.g., aluminum, steel) and composite materials (e.g., reinforced concrete, carbon fiber composite). Such bollards can also be painted, or otherwise covered or coated with a functional and/or ornamental covering (e.g., powder coating, anodization). An exemplary bollard as disclosed herein was constructed of steel and painted white. Corresponding bollard engaging members were also constructed of steel and painted white.

For ease of illustration, each bollard shown in FIGS. 1-6 is shown having a rectangular base plate 22 being affixed to a lower end of the body 26. The plate 22 has a through hole 24 located adjacent each corner of the plate for receiving a lug 25 extending from the ground, foundation or other structure. A nut 23 can threadedly engage the lug, securing the bollard 20 to the ground, foundation or other structure.

The exemplary bollards as described above have hollow prismatic bodies, such as can be manufactured by an extruding process. However, the principles discussed herein are not limited to bodies having such cross-sections. The principles described herein apply to bollards having a body of any cross-sectional profile, provided that the side wall 45 of the bracket 40 is spaced from the wall of the body 26 to accommodate any curvature of the plate 44, and/or the portion 46 and/or end portion of the coupling 52 is sufficiently long (as measured from the plate 44) to accommodate any curvature of the body 26 in a region adjacent the bracket 40 and slot 50.

Figure 6:
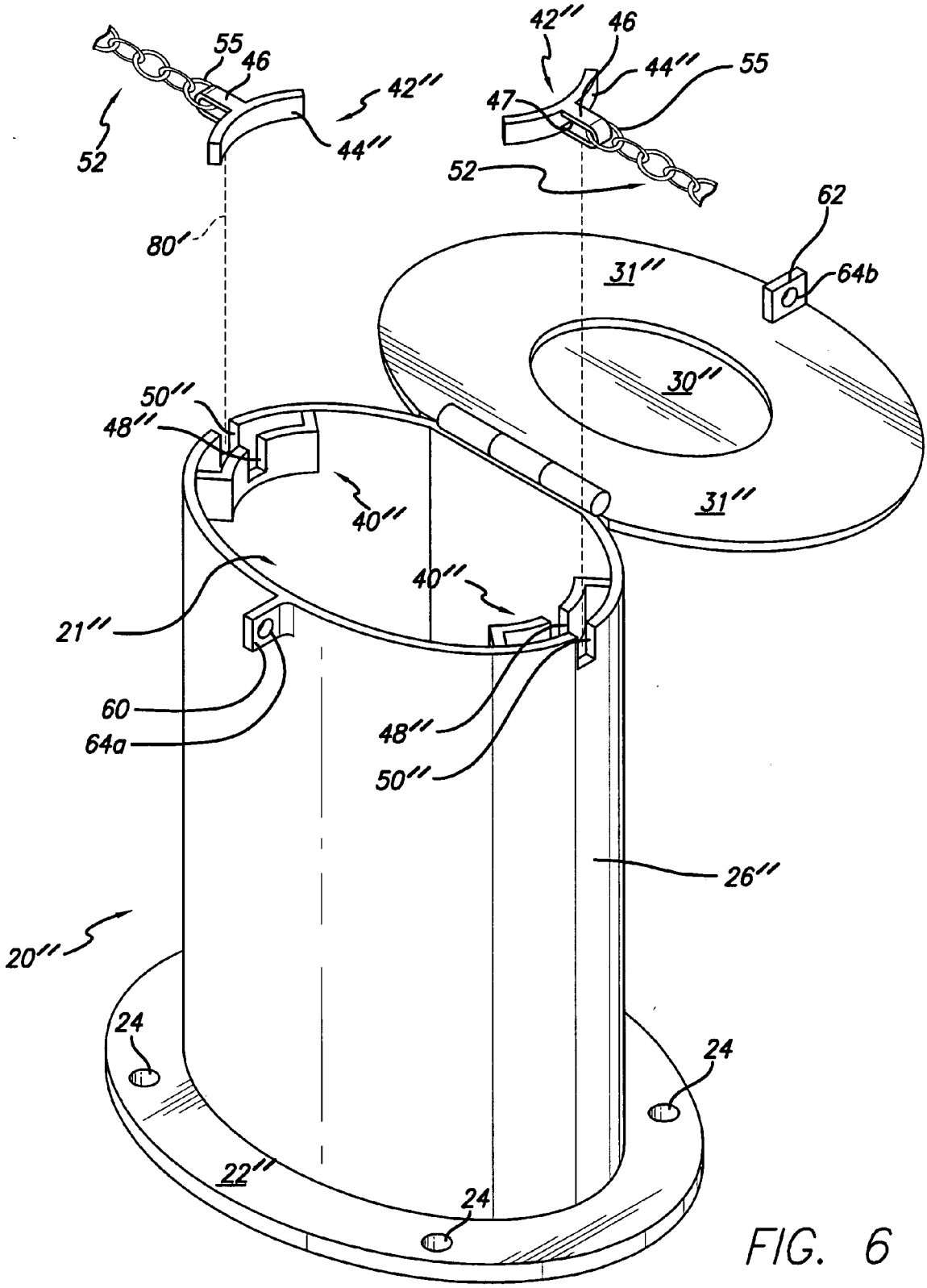
FIG. 6 illustrates another alternative bollard embodiment.

For example, referring to FIG. 6, the hollow body 26" of a bollard 20" can have an oval cross-section defining an internal volume 21". The bracket 40" can be curved to at least roughly correspond to the curvature of the body wall adjacent the bracket, as shown. The plate 44" can be formed of an elastomeric material, such as, for example, rubber, polyurethane, that resiliently deforms to correspond with the curvature of the wall of the body 26" adjacent the bracket 40" when assembled along the assembly axis 80', whether being positioned in a usage position or in a storage position. Such a pliable plate 44" can accommodate various radii of curvature, which allows the side wall of the bracket 40" to be positioned closely (relative to the thickness of the plate 44") to the wall of the body 26" and define a correspondingly small bracket volume. Close positioning of the side wall allows the plate 44" to block an outer slot, inhibiting deposits of debris within the bracket and/or hollow body 26". The cap 30" and the associated flanges 31", as well as the base 22", can have an oval shape, for example, to aesthetically correspond with the oval body 26".

Figure 7A:
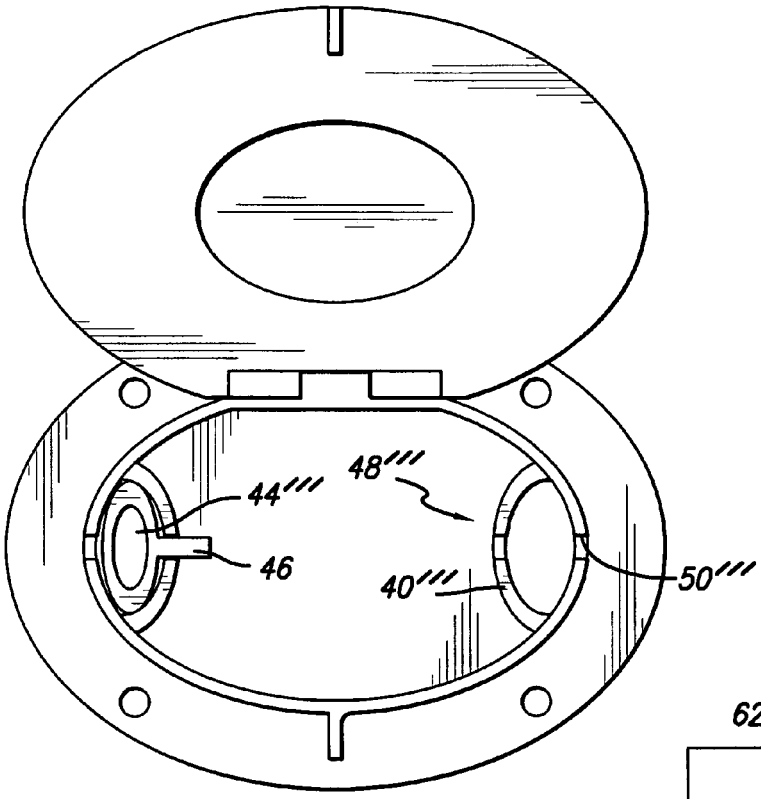
FIGS. 7A and 7B illustrate alternative embodiments of bollard engaging members configured to engage a bollard having a curved body, as illustrated in FIG. 6.
Figure 7B:
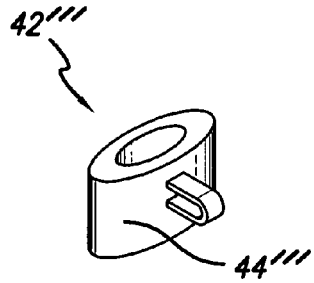

With reference to FIGS. 7A and 7B, a bollard engaging member 42'" can have a bulging plate member 44'" configured to engage a curved wall. For example, the bracket 40'", rather than having a convex curvature matching the wall curvature as in FIG. 6, can "bulge" inwardly of the bollard. Such a bracket 40'" can receive a bulging plate member 44'" in either of a usage position and a storage position, and the bulging plate member 44'" can be formed of a suitably stiff (e.g., steel) material. A bulging plate member 44'" can have any generally rounded shape, such as, for example, the "eye" shape, as shown in FIGS. 7A and 7B, an oval prismatic shape, a circular prismatic shape (e.g., a cylinder) or a spherical "ball" shape. As with the bollards, bollard engaging members and brackets described above, a bollard coupling can extend through an opening 48'" or 50'" defined by the bracket or bollard, respectively.

Various bollard arrangements using one or more of the bollards described herein are possible. For example, a bollard 20 can be positioned adjacent a structure (e.g., a wall, another bollard). A bollard coupling 52 can be stored within the bollard, or can extend between the bollard and the adjacent structure. In some instances, one end of the bollard coupling can be removably attached to the adjacent structure using conventional means, and an opposing end of the bollard coupling can have a bollard engaging member 42 affixed thereto, as described above. Bollard couplings of this type can be removed from the adjacent structure and stored within the bollard 20 as described above. Alternatively, one end of the bollard coupling 52 can be permanently affixed to the adjacent structure, and the bollard engaging member 42 can engage the bollard in a usage position, or be removed from the bollard altogether.

An exemplary bollard arrangement is shown in FIG. 4. First and second bollards 17, 19, respectively, are affixed, in this exemplary embodiment, to the ground 15 by way of lugs 25 extending vertically through the respective base plates 22. A bollard coupling 52 extends between the bollards 17, 19. A second bollard coupling extends from the right side of the second bollard 19 shown in FIG. 4. The first bollard 17 (being an end-bollard in an array of bollards) has a bollard coupling 52 positioned in a storage position 51 on the bollard's left side. The stored bollard coupling (not shown) can be repositioned to a usage position 53, as described above.

An exemplary method of repositioning a bollard coupling from a usage position to a storage position will now be described. A bollard, e.g., the bollard 17 in FIG. 4, for storing a bollard coupling 52 is selected. A distal end of the bollard coupling (e.g., the end engaging the bollard 19) is freed from a corresponding retainer (e.g., the bollard 19).

The cap 30 of the bollard 17 is moved from a closed position (e.g., FIG. 4) to an open position (FIG. 2B), exposing, in this example, a bollard engaging member 42 (FIG. 2B) fixedly attached to an end portion 55 of the bollard coupling 52 and positioned within a corresponding bracket 40 as described above. The bollard engaging member 42 is slid from the corresponding bracket to remove the bollard engaging member from the interior body volume defined by the walls 43, 45 of the bracket 40 and the body 26 (e.g., along the axis 80 shown in FIG. 1). The freed distal end of the bollard coupling 52 is positioned within the hollow body 26 (as shown in FIG. 2A). The bollard engaging member is repositioned such that the portion 46 and/or end portion 55 extends inwardly of the body 26 (FIG. 2A). The plate 44 is positioned within the bracket 40 and the body 26, placing the bollard coupling 52 in a storage position 51. The cap 30 is positioned in a closed position (e.g., FIG. 3A) to secure the bollard coupling in the storage position, as by, for example, securing a padlock 65 to the tabs 60, 62 as described above.

In one method of assembling a bollard arrangement, such as that shown in FIG. 4, a cap 30 is opened to expose a stored bollard coupling (FIG. 2A). A bollard engaging member is repositioned from a storage position 51 to a usage position 52. The cap 30 is releasably secured to the body 20 to impede unauthorized removal of the bollard engaging member. A distal end of the bollard coupling 52 can be retained by an adjacent retainer, such as the bollard 19 (FIG. 4).

This disclosure makes reference to the accompanying drawings which form a part hereof, wherein like numerals designate like parts throughout. The drawings illustrate specific embodiments, but other embodiments may be formed and structural changes may be made without departing from the intended scope of this disclosure. Directions and references (e.g., up, down, top, bottom, left, right, rearward, forward, etc.) may be used to facilitate discussion of the drawings but are not intended to be limiting. For example, certain terms may be used such as "up," "down,", "upper," "lower," "horizontal," "vertical," "left," "right," and the like. These terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" surface can become a "lower" surface simply by turning the object over. Nevertheless, it is still the same surface and the object remains the same. As used herein, "and/or" means "and" as well as "and" and "or."

Figure 8:
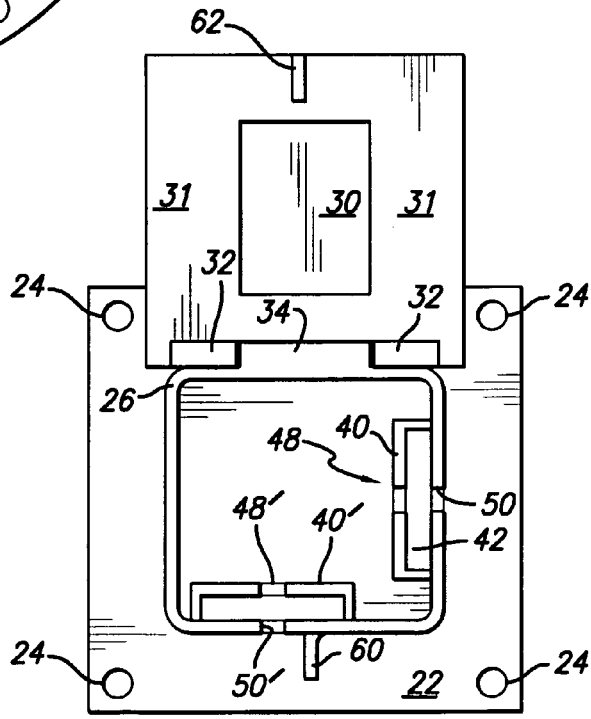
FIG. 8 illustrates yet another bollard embodiment.

Accordingly, this detailed description shall not be construed in a limiting sense, and following a review of this disclosure, those of ordinary skill in the art will appreciate the wide variety of traffic control configurations that can be constructed using the various bollards and couplings described herein. Moreover, those of ordinary skill in the art will appreciate that the exemplary bollards disclosed herein can be adapted to various configurations without departing from the concepts providing storage for bollard couplings, among other advantages. For example, any number of bollards can be arranged in any of various configurations to demarcate one or more corresponding boundaries. End bollards (e.g., the first bollard 17 shown in FIG. 4) can be constructed having only one bracket 40 for reversibly receiving a bollard engaging member (rather than two as described above) and can be located at a terminal end of a bollard arrangement as in FIG. 4. Other bollards can be constructed having more than two brackets (and corresponding slots, couplings and engaging members) to define reconfigurable boundaries with reversibly engaging bollard couplings and, in some instances, statically affixed bollards. Bollards as disclosed herein can have brackets affixed in an opposing relationship (e.g., FIG. 1), or adjacent another bracket (e.g., on the same or an adjacent wall of a bollard body as shown in FIG. 8). With respect to FIG. 8, the bracket 40' defines a slot 48' opposite a slot 50' defined in the body 26. The bracket 40' is located adjacent the bracket 40, and is of a similar construction compared to the bracket 40 described above.

In view of the many possible embodiments to which the principles of the disclosed innovations can be applied, it should be recognized that the above-described embodiments are only examples and should not be taken as limiting the scope of what is claimed. Rather, the scope of what is claimed is set forth in the following claims. I therefore claim as my invention all that comes within the scope and spirit of these claims.

I claim:

1. A bollard comprising:

a body comprising one or more body walls defining an interior body volume and a first body slot in one of the body walls;

a first bracket comprising first-bracket end walls and a first-bracket side wall, wherein the first-bracket end walls, the first-bracket side wall, and the one of the body walls define a first-bracket interior volume, wherein the first-bracket side wall defines a first-bracket slot, and wherein the first bracket is attached to the one of the body walls adjacent the first body slot such that the first body slot is in communication with the first-bracket interior volume; and a cap being releasably securable to the body to at least partially enclose the interior body volume and for retaining a bollard engaging member positioned within the first-bracket interior volume.

2. The bollard of claim 1, wherein the first bracket is positioned within the interior body volume.

3. The bollard of claim 1, comprising a second bracket defining a second-bracket interior volume for receiving a bollard engaging member positioned within the second-bracket interior volume.

4. The bollard of claim 1 in combination with a bollard coupling defining an end fixedly attached to a bollard engaging member, wherein the bollard engaging member comprises a plate configured to matingly engage the first bracket.

5. The combination of claim 4, wherein the bollard coupling extends inwardly into the interior body volume when the plate matingly engages the first bracket in a storage position, and wherein the bollard coupling extends outwardly relative to the interior body volume when the plate matingly engages the first bracket in a usage position.

6. A bollard comprising:

a body defining an interior body volume and a first opening;

a bracket fixedly attached to the body and defining a second opening, wherein the bracket and the first opening are together configured to reversibly receive a bollard engaging member being fixedly attached to an end portion of a bollard coupling and positioned in a selected one of a usage position and a storage position; and a cap configured to be releasably secured to the body in a first position for securely retaining the bollard engaging member, and positionable to a second position for providing access to the interior body volume.

7. The bollard of claim 6, wherein at least one of the first opening and the second opening comprises a slot.

8. The bollard of claim 6, wherein the bracket is positioned externally relative to the interior body volume.

9. The bollard of claim 8, wherein the bollard and the bracket are together configured such that at least a portion of the bollard engaging member extends through the second opening when the bollard engaging member is positioned in a usage position and such that at least a portion of the bollard engaging member extends through the first opening when the bollard engaging member is positioned in a storage position.

10. The bollard of claim 6, wherein the bracket is positioned within the interior body volume.

11. The bollard of claim 10, wherein the bollard and the bracket are together configured such that at least a portion of the bollard engaging member extends through the first opening when the bollard engaging member is positioned in a usage position and such that at least a portion of the bollard engaging member extends through the second opening when the bollard engaging member is positioned in a storage position.

12. The bollard of claim 6 in combination with the bollard coupling, wherein the bollard engaging member comprises a plate member being oriented substantially perpendicularly to a longitudinal axis of the bollard coupling, and wherein the plate member urges against the body when the bollard engaging member is positioned in a usage position.

13. The bollard of claim 6 in combination with the bollard coupling, wherein the bollard engaging member comprises a plate member being oriented substantially perpendicularly to a longitudinal axis of the bollard coupling, and wherein the plate member urges against the bracket when the bollard engaging member is positioned in a storage position.

14. The bollard of claim 6, wherein the bracket comprises a bracket wall spaced from the body to define a channel therebetween, and wherein the bracket wall defines the second opening, such that the second opening is spaced from and located opposite the first opening.

15. The bollard of claim 14, wherein the bollard engaging member comprises a plate member and the channel is sized to slidably receive the plate member.

16. The bollard of claim 10, in combination with the bollard coupling, wherein the bollard engaging member comprises a plate member and a linking portion extending from the plate member at about a right angle for coupling the end portion of the bollard coupling to the plate member, wherein the bracket slidably receives the plate member in the bollard coupling position and in the storage position.

17. A method comprising:

accessing a bollard engaging member engaging a bollard having at least one wall, the bollard engaging member being attached to an end of a bollard coupling and being at least partially positioned within a volume defined by a bracket having opposing end walls joining one of the at least one wall and a side wall spaced therefrom in a storage position or a usage position;

removing the bollard engaging member from its engagement with the bollard;

repositioning the bollard engaging member to the other one of the storage position and the usage position; and releasably securing a cap to the bollard to retain the repositioned bollard engaging member.

18. The method of claim 17, wherein the act of accessing a bollard engaging member comprises releasing a releasably secured cap.

19. The method of claim 17, wherein the act of repositioning the bollard engaging member comprises extending the bollard coupling between the bollard and an adjacent structure so as to couple the bollard and the adjacent structure.

20. The method of claim 19, wherein the adjacent structure comprises a second bollard.

21. The method of claim 17, wherein the act of repositioning the bollard engaging member comprises placing the bollard coupling within the bollard.

* * * * *